US009481102B1

(12) United States Patent
Hojnacki et al.

(10) Patent No.: US 9,481,102 B1
(45) Date of Patent: Nov. 1, 2016

(54) SPACER FOR A CABLE TIE TENSIONING AND SEVERING TOOL

(71) Applicant: The Boeing Company, Chicago, IL (US)

(72) Inventors: Edward M. Hojnacki, Charleston, SC (US); Joe E. Sharp, Mount Pleasant, SC (US)

(73) Assignee: The Boeing Company, Chicago, IL (US)

( * ) Notice: Subject to any disclaimer, the term of this patent is extended or adjusted under 35 U.S.C. 154(b) by 434 days.

(21) Appl. No.: 14/022,852

(22) Filed: Sep. 10, 2013

(51) Int. Cl.
*B65B 13/02* (2006.01)
*B26D 7/00* (2006.01)

(52) U.S. Cl.
CPC ..... *B26D 7/0006* (2013.01); *B65B 13/027* (2013.01)

(58) Field of Classification Search
CPC . B65B 13/025; B65B 13/027; B26D 7/0006; B21F 9/002; B21F 11/00
USPC ..... 140/123.6
See application file for complete search history.

(56) References Cited

U.S. PATENT DOCUMENTS

| | | | | |
|---|---|---|---|---|
| 3,661,187 | A * | 5/1972 | Caveney | B65B 13/027 140/123.6 |
| 5,492,156 | A * | 2/1996 | Dyer | B65B 13/027 140/123.6 |
| 5,832,964 | A * | 11/1998 | Joshi | B65B 13/027 140/123.6 |
| 5,921,290 | A * | 7/1999 | Dyer | B65B 13/027 140/123.6 |
| 7,299,830 | B2 * | 11/2007 | Levin | B65B 13/027 140/123.6 |
| 2006/0037661 | A1 * | 2/2006 | Lueschen | B65B 13/027 140/123.6 |

OTHER PUBLICATIONS

Panduit: Cable Ties and Accessories, www.panduit.com, 20 pages (2013).

* cited by examiner

*Primary Examiner* — Edward Tolan
(74) *Attorney, Agent, or Firm* — Walters & Wasylyna LLC

(57) ABSTRACT

A spacer may include a spacer body configured to be connected to a cable tie tensioning and severing tool, the cable tie tensioning and severing tool being configured for installation of a cable tie, the cable tie including a head and an elongated tail extending from the head, wherein the spacer is configured to space the head of the cable tie away from the cable tie tensioning and severing tool such that a portion of the tail protrudes from the head upon the tail being severed by the cable tie tensioning and severing tool.

20 Claims, 7 Drawing Sheets

SPACER FOR A CABLE TIE TENSIONING AND SEVERING TOOL

FIELD

The present disclosure is generally related to cable tie installation and, more particularly, to a spacer for a hand-held cable tie tensioning and severing tool used for cable tie installation.

BACKGROUND

Cable ties are commonly used to bundle or secure a group of objects, such as electrical wires and cables. Cable ties of conventional construction include a head and an elongated tail extending from the head. The tail is wrapped around one or more objects and inserted through a passage in the head. The head of the cable tie typically supports a locking element, which extends into the head passage and engages the body of the tail to secure the tail to the head.

In practice, installation of the cable tie includes manually placing (e.g., looping) the tie around the objects to be bundled, inserting the tail through the head passage, and then manually tightening the tie about the bundle. A cable tie installation tool, such as a cable tie tensioning and severing tool, may be used to tension the cable tie to a predetermined tension. Once the tension approaches the desired tension, the tool severs the excess tail portion from the cable tie (e.g., the portion of the tail that extends beyond the head of the cable tie).

The tail is typically severed substantially flush with the head due to the head being positioned in close proximity to the severing mechanism of the cable tie installation tool upon the cable tie being fully tensioned. As a result, the cable tie is generally incapable of being tightened further after the tail has been severed and thus the cable tie is generally viewed as a single-use fastening device.

Accordingly, those skilled in the art continue with research and development efforts in the field of cable tie installation.

SUMMARY

In one embodiment, the disclosed spacer may include a spacer body configured to be connected to a cable tie tensioning and severing tool, the cable tie tensioning and severing tool being configured for installation of a cable tie, the cable tie including a head and an elongated tail extending from the head, wherein the spacer is configured to space the head away from the cable tie tensioning and severing tool.

In another embodiment, the disclosed spacer may include a cable tie tensioning and severing tool configured to tension a cable tie, the cable tie tensioning and severing tool including a front end configured to receive and sever a tail of the cable tie, and a spacer connected to the front end of the cable tie tensioning and severing tool, the spacer being configured to longitudinally space the head away from the front end of the cable tie tensioning and severing tool such that a portion of the tail protrudes from the head upon the tail being severed by the cable tie tensioning and severing tool.

In yet another embodiment, also disclosed is a method for tensioning and severing a cable tie, the method may include the steps of: (1) providing a cable tie including a head and an elongated tail extending from the head, (2) providing a cable tie tensioning and severing tool configured to tension and sever the cable tie, (3) providing a spacer connected to the cable tie tensioning and severing tool, (4) installing the cable tie around one or more objects, (5) passing the tail through the spacer and into the cable tie tensioning and severing tool such that the head is longitudinally spaced away from the cable tie tensioning and severing tool, (6) tensioning the cable tie, and (7) severing the tail such that a protruding portion of the tail comprises a cut-off length sufficient for secondary tightening of the cable tie.

Other embodiments of the disclosed spacer for a cable tie tensioning and severing tool for installation of a cable tie will become apparent from the following detailed description, the accompanying drawings and the appended claims.

DETAILED DESCRIPTION

Figure 1:
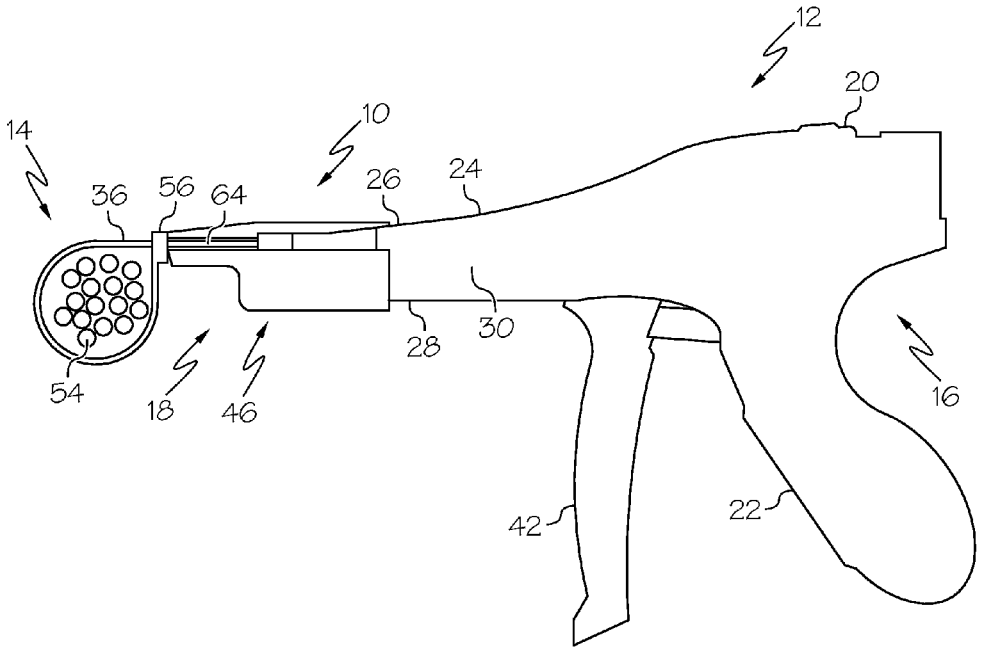
FIG. 1 is a side elevational view of one embodiment of the disclosed spacer shown connected to a cable tie tensioning tool.

The following detailed description refers to the accompanying drawings, which illustrate specific embodiments of the disclosure. Other embodiments having different structures and operations do not depart from the scope of the present disclosure. Like reference numerals may refer to the same element or component in the different drawings.

Figure 2:
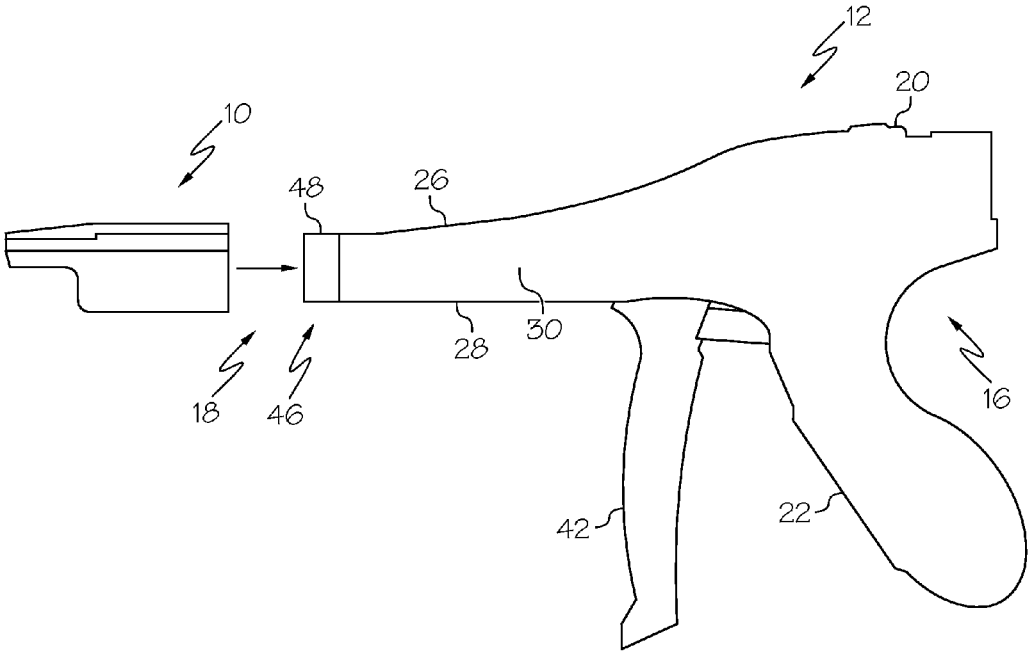
FIG. 2 is an exploded side elevational view of the disclosed spacer for a cable tie tensioning tool.

Referring to FIGS. 1 and 2, the disclosed spacer, generally designated 10, may be connected to a cable tie tensioning and severing tool 12 for tensioning and severing a cable tie 14, for example around a bundle of wires 54 (FIG. 1). The spacer 10 may be configured to position a head 56 of the cable tie 14 away from an end of the cable tie tensioning and severing tool 12 in order to provide an additional length of a tail 36 of the cable tie 14 protruding from the head 56 (e.g., a protruding portion 64) upon the cable tie 14 being tensioned and the tail 36 being severed by the cable tie tensioning and severing tool 12.

The cable tie 14 (FIG. 1), also commonly referred to as a zip tie, a tie-wrap, or a clamp band, may include any fastener configured to be secured around and or organize one or more objects 54 (e.g., a bundle of electric cables or wires), but with a wide variety of other applications. For example, the cable tie 14 may include an elongated tail 36 extending from the head 56. The tail 36 may include a plurality of triangular teeth (not shown) that slope in one direction. The head 56 may include a slot (not shown) with a flexible pawl (not shown) that irreversibly rides up the slope of the teeth when the tail 36 is looped and passed through the slot, such that the pawl engages the backside of the teeth to stop removal of the tail 36.

The cable tie tensioning and severing tool 12, also commonly referred to as a cable tie gun, a tie-wrap gun, or a zip tie gun, may include any hand-held cable tie installation tool configured for tensioning and severing a cable tie 14 (FIG. 1). For example and without limitation, the cable tie tensioning and severing tool 12 may be a hand operated cable tie installation tool manufactured by Panduit Corporation of Tinley Park, Ill.

Figure 3:
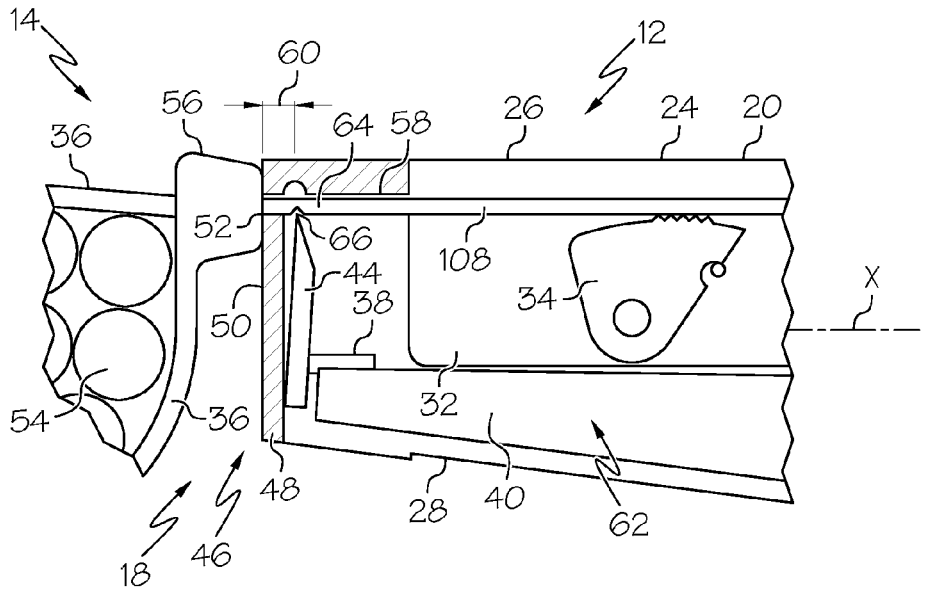
FIG. 3 is a partial side elevational view, in section, of one embodiment of the cable tie tensioning tool of FIG. 2.

In the illustrated embodiment, the cable tie tensioning and severing tool 12 may include a first (e.g., rear) end 16 and an opposed second (e.g., front) end 18. The cable tie tensioning and severing tool 12 may include a housing 20, for example, in the shape of a pistol or gun having a handle portion 22 and a barrel portion 24. The housing 20 may include a pair of complimentary and opposed sidewalls secured together to define the handle portion 22, the barrel portion 24, and a hollow interior 62 (FIG. 3). For example, the handle portion 22 may include a front, a back, opposite sides, and a bottom. As shown in the illustrated embodiment, the handle portion 22 may include an ergonomic design.

The barrel portion 24 may include a top 26, a bottom 28, and opposite sides 30 (e.g., a right side and a left side) (only the right side 30 is shown in FIGS. 1 and 2). The barrel portion 24 may extend from the handle portion 22 to the front end 18 of the cable tie tensioning and severing tool 12. The top 26, bottom 28, and sides 30 of the barrel portion 24 may include any suitable shape or configuration. For example, in the illustrated embodiment, at least a portion of the top 26, bottom 28, and sides 30 may include a substantially planar (e.g., flat) configuration proximate (e.g., at or near) the front end 18 of the cable tie tensioning and severing tool 12.

Referring to FIG. 3, the cable tie tensioning and severing tool 12 may include various internal parts and mechanism disposed within the interior of the housing 20 configured to tension and sever the cable tie 14. Generally, the cable tie tensioning and severing tool 12 may include a reciprocating tensioning mechanism 32 (e.g., one or more elongated linkages, a tension rod, or the like) and a gripper assembly 34 for gripping the tail 36. The reciprocating tensioning mechanism 32 may extend substantially along the longitudinal axis X of the barrel portion 24. The gripper assembly 34 may be disposed proximate the front end 18 of the cable tie tensioning and severing tool 12.

The reciprocating tensioning mechanism 32 may be operably connected to a manually operated trigger 42 (FIGS. 1 and 2) by a mechanical linkage assembly 40. An actuating mechanism 38 may be operably connected to the trigger 42 by a mechanical linkage (e.g., the mechanical linkage assembly 40). The actuating mechanism 38 may also be operably connected to a tie severing mechanism 44 (e.g., a severance blade) disposed proximate a front end 46 of the barrel portion 24 (e.g., proximate the front end 18 of the cable tie tensioning and severing tool 12).

The cable tie tensioning and severing tool 12 may include an end plate 48 (e.g., a blade guard) fixed to the front end 46 of the barrel portion 24. The end plate 48 may include a forward surface 50 (e.g., a planar surface or a recessed surface) facing away from the barrel portion 24. The end plate 48 may include a tie slot 52 disposed through the forward surface 50, through which the tail 36 of the cable tie 14 may pass (e.g., after the tail 36 has been first passed around a bundle of wires 54 and threaded through the head 56).

In operation, the tail 36 may be positioned through the tie slot 52 and into the cable tie tensioning and severing tool 12. The tail 36 may be positioned generally horizontally, between the tie severing mechanism 44 and a horizontal surface 58 of the end plate 48, with the head 56 of the cable tie 14 abutting a portion of the forward surface 50 of the end plate 48. The actuation mechanism 38 may pivot between a cable tie insertion position and a cable tie severance position upon actuation of the trigger 42 (FIGS. 1 and 2). The gripper assembly 34 may move between a cable tie insertion position and a cable tie tension position upon actuation of the trigger 42. The gripper assembly 34 may be mounted (e.g., pivotally mounted) proximate a forward end of a reciprocating tensioning mechanism 32 to selectively draw the tail 36 inward to tension the cable tie 14 (e.g., around a bundle of wires 54).

The cable tie tensioning and severing tool 12 may draw the tail 36 into the barrel portion 24 and tension the cable tie 14 until a predetermined tension is sensed by a tool mechanism (not shown), which then actuates the actuation mechanism 38 and drives the tie severing mechanism 44 upward to sever the tail 36 (e.g., at a severed end 66) proximate the head 56 of the cable tie 14. The position of the cable tie 14 with respect to the front end 18 of the cable tie tensioning and severing tool 12 may provide a reduced cut-off length $l_1$ 60 of a protruding portion 64 of the tail 36 (e.g., the length of the tail 36 from the head 56 to the severed end 66 of the tail 36 upon being severed by the tie severing mechanism 44).

For example, a minimal cut-off length $l_1$ 60 of the protruding portion 64 of the tail 36 may be achieved from the disclosed arrangement (e.g., the severed end 66 being substantially flush with the head 56). For example, the cut-off length $l_1$ 60 may be less than or equal to 10 mm, less than or equal to 5 mm, less than or equal to 3 mm, less than or equal to 1 mm, or substantially zero.

Generally, the cable tie 14 may be only slightly elastically stretched when tensioned and the pawl disposed within the head 56 may withdraw a portion of the protruding portion 64 of the tail 36 back towards the head 56 when the tail 36 is severed, thus further facilitating a substantially flush cut-off length $l_1$ 60.

In certain circumstances, the cable tie 14 may become loose over time. For example, objects 54 secured by the cable tie 14 (e.g., the bundle of wires) may begin to settle or the cable tie 14 itself may stretch. Thus, it may be beneficial to have the ability to retighten the cable tie 14 after the cable tie 14 has initially been tightened (e.g., around a bundle of wires) and severed. The minimal cut-off length $l_1$ 60 may not allow for secondary tightening of the cable tie 14 and may require the cable tie 14 to be removed (e.g., cut off) and a new cable tie 14 to be secured around the objects.

Figure 4:
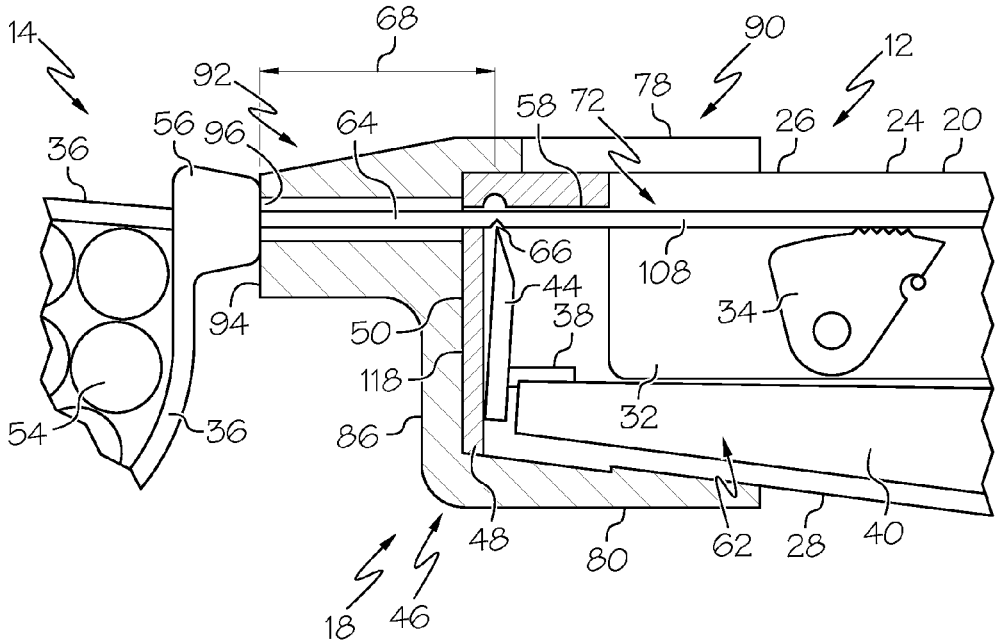
FIG. 4 is a partial side elevational view, in section, of the disclosed spacer and cable tie tensioning tool of FIG. 1.

Referring to FIG. 4, the spacer 10 may extend from the front end 18 of the cable tie tensioning and severing tool 12 and be configured to provide an elongated protruding portion 64 of the tail 36 suitable for secondary tightening of the cable tie 14. The spacer 10 may be positioned between the front end 18 of the cable tie tensioning and severing tool 12 and the head 56 of the cable tie 14 and be configured to receive the tail 36 of the cable tie 14. For example, the spacer 10 may be connected to the front end 46 of the barrel portion 24 of the housing 20 to longitudinally space the head 56 away from the severed end 66 (e.g., away from the tie severing mechanism 44 of the cable tie tensioning and severing tool 12).

In operation, the tail 36 may be positioned through the spacer 10 and into the cable tie tensioning and severing tool 12. The tail 36 may be positioned generally horizontally, between the tie severing mechanism 44 and a horizontal surface 58 of the end plate 48, with the head 56 of the cable tie 14 abutting a portion of the spacer 10. The cable tie tensioning and severing tool 12 may draw the tail 36 into the barrel portion 24 and tension the cable tie 14 until a predetermined tension is sensed by a tool mechanism, which then severs the tail 36 (e.g., at the severed end 66) away from the head 56 of the cable tie 14. The position of the cable tie 14 with respect to the front end 18 of the cable tie tensioning and severing tool 12 may provide an elongated cut-off length $l_2$ 68 of a protruding portion 64 of the tail 36 (e.g., the length of the tail 36 from the head 56 to the severed end 66 of the tail 36 upon being severed by the tie severing mechanism 44).

The elongated cut-off length $l_2$ 68 of the protruding portion 64 of the tail 36 may be achieved from the disclosed arrangement (e.g., the severed end 66 being spaced away from the head 56). For example, the cut-off length $l_2$ 68 of the protruding portion 64 of the tail 36 may be sufficient for use with a standard cable tie tensioning and severing tool 12 (e.g., a cable tie tensioning and severing tool 12 without the disclosed spacer 10) to perform a secondary tensioning and severing operation on the cable tie 14.

For example, the cut-off length $l_2$ 68 may be greater than or equal to 10 mm, greater than or equal to 20 mm, greater than or equal to 30 mm, greater than or equal to 40 mm, or greater than or equal to 50 mm. Those skilled in the art will appreciate that the cut-off length $l_2$ 68 of the protruding portion 64 of the tail 36 may depend upon the specific type or model of cable tie tensioning and severing tool 12 expected to be used to perform the secondary tensioning and severing operation on the cable tie 14. For example, the cut-off length $l_2$ 68 may be at least about 31 mm (e.g., at least 31.74 mm) to ensure the protruding portion 64 is sufficiently long for use with a Panduit GS4H Cable Tie Tool manufactured by Panduit Corporation of Tinley Park, Ill.

Those skilled in the art will appreciate that cut-off length $l_2$ 68 of the protruding portion 64 may be defined by the size and shape of the spacer 10. The particular configuration of the spacer 10 may be sufficient for connection to the cable tie tensioning and severing tool 12 without limitation. Those skilled in the art will also appreciate that the size, shape, and configuration of the spacer 10 may depend on various factors including, but not limited to, the type, the size, the make, and the model of a particular cable tie tensioning and severing tool 12.

FIGS. 5-10 illustrate various views of one embodiment of the disclosed spacer 10. The spacer 10 may include a spacer body 70 including a first (e.g., rear) end 74 and a longitudinally opposed second (e.g., front) end 76. The spacer body 70 may include a connector portion 90 and a standoff portion 92. The spacer body 70 may include at least one wall defining the connector portion 90 and the standoff portion 92.

The connector portion 90 may define an open interior volume 72. The interior volume 72 may be configured to receive at least a portion of the front end 18 of the cable tie tensioning and severing tool 12 to connect the spacer 10 to the cable tie tensioning and severing tool 12. For example, the interior volume 72 may be suitably sized and shaped to receive the front end 46 of the barrel portion 24. The shape and dimensions of the interior volume 72 may be in close tolerance with the exterior shape and dimensions of the front end 46 of the barrel portion 24 such that the spacer body 70 may be secured to the cable tie tensioning and severing tool 12 by a friction fit.

The standoff portion 92 may extend outwardly from the connector portion 90 to the front end 76 of the spacer body 70. The standoff portion 92 may be configured to space the head 56 away from the front end 18 of the cable tie tensioning and severing tool 12 (e.g., away from the tie severing mechanism 44), as illustrated in FIG. 4. The standoff portion 92 may include a forward surface 94 facing away from the connector portion 90. The standoff portion 92 may include a tie slot 96 disposed through the forward surface 94. The tie slot 96 may extend from the forward surface 94 to the interior volume 72. The head 56 may abut the forward surface 94 of the standoff portion 92 and the tail 36 may pass through the tie slot 96 of the spacer 10 before being passed through the tie slot 52 of the cable tie tensioning and severing tool 12 (e.g., after the tail 36 has been first passed around the bundle of wires 54 and threaded through the head 56) (FIG. 4).

In an example construction, the spacer body 70 may include an upper wall 78 and an opposed lower wall 80. The upper wall 78 may be spaced apart from and substantially parallel to the lower wall 80. The spacer body 70 may include a first (e.g., right) sidewall 82 and an opposed second (e.g., left) sidewall 84. The right sidewall 82 may be laterally spaced apart from and substantially parallel to the left sidewall 84. The spacer body 70 may include a front wall 86. The tie slot 96 may extend from through the front wall 86 and into the interior volume 72. The rear end 74 of the spacer body 70 may include an opening 88 opposite the front wall 86 to access the interior volume 72.

For example, the right sidewall 82 may longitudinally extend from the front end 76 to the rear end 74. The left sidewall 84 may longitudinally extend from the front end 76 to the rear end 74. The left sidewall 84 may be laterally opposed to the right sidewall 82. The front wall 86 may laterally extend between the right sidewall 82 and the left sidewall 84. The front wall 86 may be disposed between the front end 76 and the rear end 74. The upper wall 78 may longitudinally extend from the front end 76 to the rear end 74. The upper wall 78 may laterally extend between the right sidewall 82 and the left sidewall 84. The lower wall 80 may longitudinally extend from the front end 76 to the rear end 74. The lower wall 80 may laterally extend between the right sidewall 82 and the left sidewall 84 opposite the upper wall 78. The opening 88 may be proximate the rear end 74 longitudinally opposed to the front wall 86. The opening 88 may be configured to receive a front end 46 of the cable tie tensioning and severing tool 12. The front end of the cable tie tensioning and severing tool may be configured to receive the tail 36.

At least a portion of an interior surface 110 of the upper wall 78 may be configured to engage (e.g., frictionally engage) at least a portion of the top 26 of the barrel portion 24 proximate the front end 46 (FIG. 4). At least a portion of an interior surface 112 of the lower wall 80 may be configured to engage at least a portion of the bottom 28 of the barrel portion 24 proximate the front end 46. At least a portion of an interior surface 114 of the right sidewall 82 may be configured to engage at least a portion of the right side 30 of the barrel portion 24 proximate the front end 46. At least a portion of an interior surface 116 of the left sidewall 84 may be configured to engage at least a portion of the left side 30 of the barrel portion 24 proximate the front end 46. At least a portion of an interior surface 118 of the front wall 86 may be configured to engage at least a portion of the forward surface 50 of the end plate 48 of the barrel portion 24.

Figure 5:
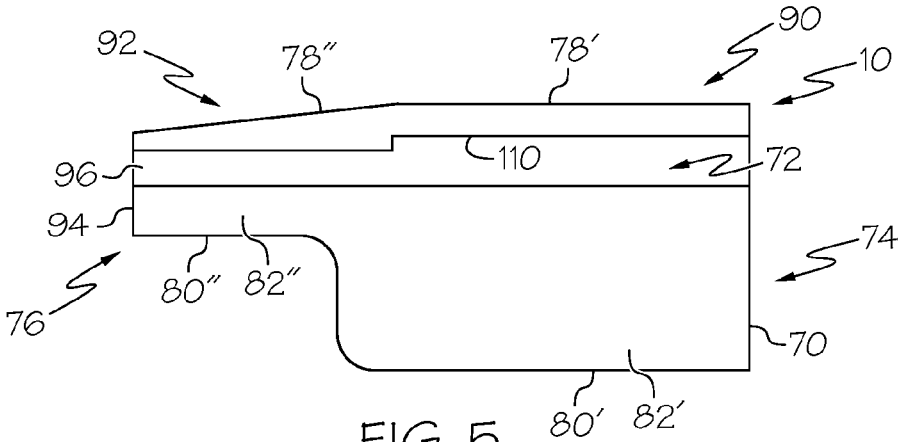
FIG. 5 is a right side elevational view the disclosed spacer.
Figure 6:
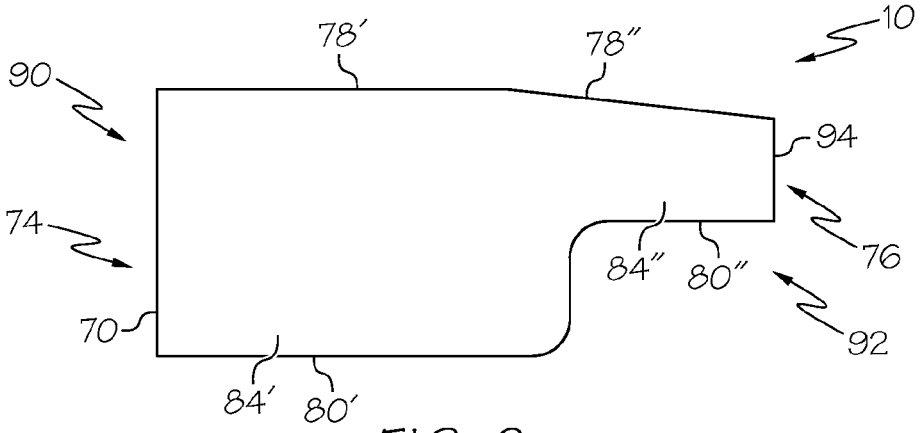
FIG. 6 is a left side elevational view of the disclosed spacer.
Figure 7:
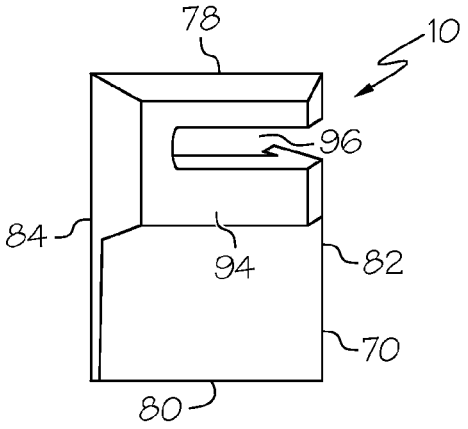
FIG. 7 if a front elevational view of the disclosed spacer.
Figure 8:
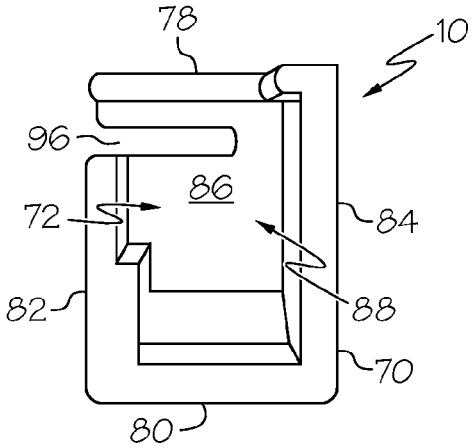
FIG. 8 is a rear elevational view of the disclosed spacer.

Referring to FIGS. 5 and 6, a first portion of the right sidewall 82', a first portion of the left sidewall 84', a first portion of the upper wall 78', a first portion of the lower wall 80', and the front wall 86 may define the connector portion 90. A second portion of the right sidewall 82", a second portion of the left sidewall 84", a second portion of the upper wall 78", and a second portion of lower wall 80" may define the standoff portion 92.

The first portion of the lower wall 80' may extend from the opening 88 (e.g., the rear end 74 of the spacer body 70) to the front wall 86. The second portion of lower wall 80" may extend from the front wall 86 to the forward surface 94 (e.g., the front end 76 of the spacer body 70). The second portion of the lower wall 80" may be vertically displaced (e.g., upwardly) relative to the first portion of the lower wall 80'.

The first portion of the upper wall 78' may extend from the opening 88 (e.g., the rear end 74 of the spacer body 70) to proximate the front wall 86. The second portion of the upper wall 78" may extend from proximate the front wall 86 to the forward surface 94 (e.g., the front end 76 of the spacer body 70). The second portion of the upper wall 78" may be angled (e.g., downwardly sloped) from the first portion of the upper wall 78' to the forward surface 94.

Figure 9:
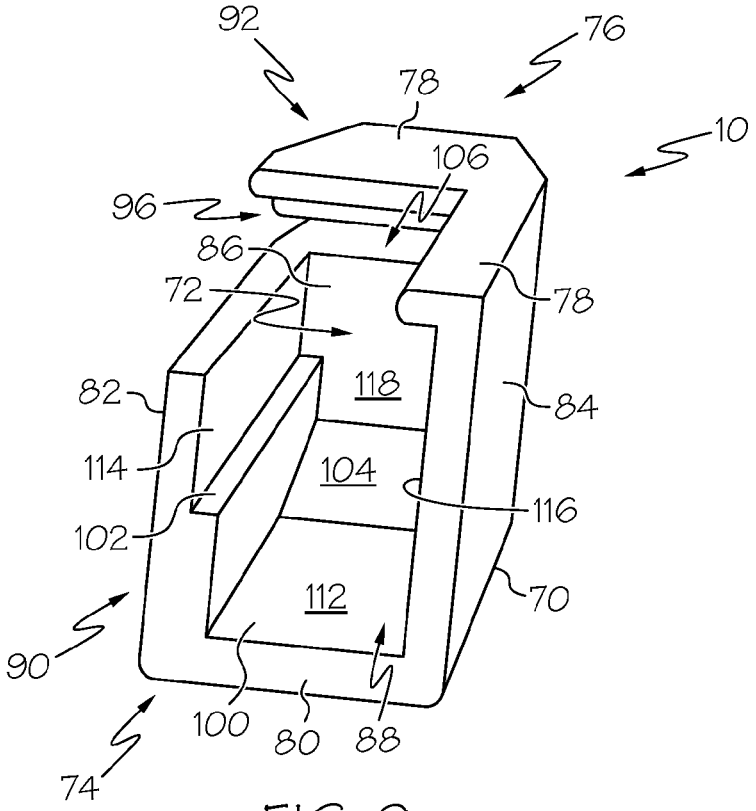
FIG. 9 is a rear and top perspective view of the disclosed spacer.
Figure 10:
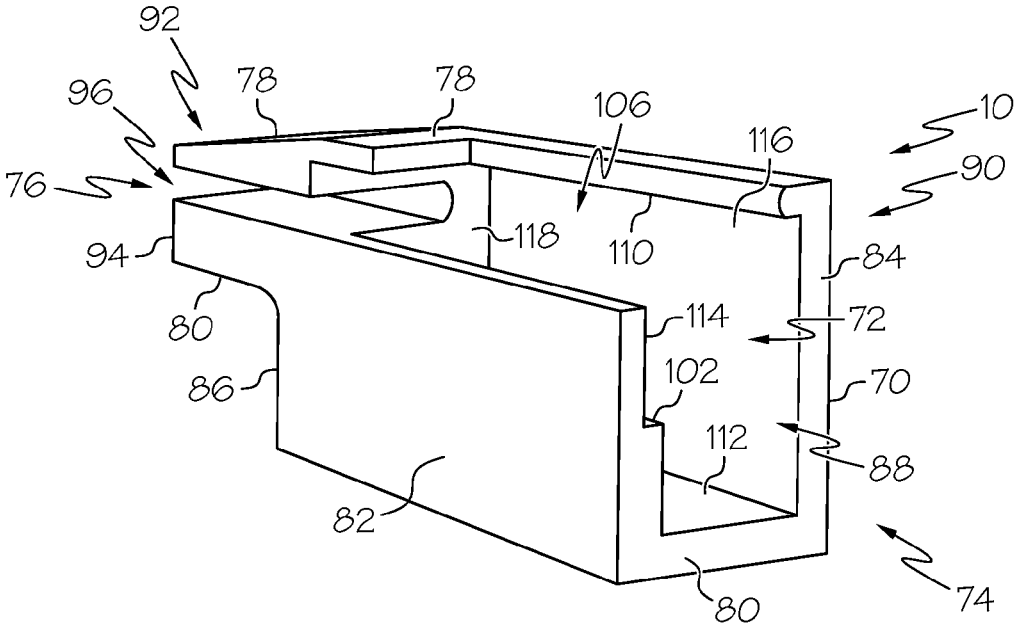
FIG. 10 is a rear and right side perspective of the disclosed spacer.

Referring to FIGS. 9 and 10, an interior surface 100 of the connector portion 90 (e.g., one or more of the interior surfaces of the first portion of the right sidewall 82', first portion of the left sidewall 84', first portion of the upper wall 78', first portion of the lower wall 80', and/or front wall 86) (FIGS. 5 and 6) may define the shape of the interior volume 72. In an example construction, the interior surface 100 may include various surface features 102 and/or surface contours 104 configured to match features and/or contours of the exterior profile of the front end 46 of the barrel portion 24 of the cable tie tensioning and severing tool 12.

Referring again to FIGS. 5-10, in another example construction, the tie slot 96 may extend from the left sidewall 84 entirely through the right sidewall 82. The tie slot 96 may also extend from the forward surface 94 (e.g., the front end 76) to the opening 88 (e.g., the rear end 74). This construction may be particularly suited for certain styles of cable tie tensioning and severing tools 12 including an elongated tie slot 52 extending through both the front end 46 of the barrel portion 24 (e.g., the end plate 48) and a side 30 of the barrel portion 24 of the housing 20 (FIG. 2) and configured to receive the tail 36. In operation, the tail 36 may be positioned through the tie slot 96 of the spacer body 70 and into the tie slot 52 of the cable tie tensioning and severing tool 12 either from the front and/or from the side.

In another example construction, a portion of the upper wall 78 (e.g., a portion of the first portion of the upper wall 78') (FIGS. 5 and 6) may include a cutout 106 accessing the interior volume 72. This construction may be particularly suited for certain styles of cable tie tensioning and severing tools 12 including an aperture or similar opening disposed in the top 26 of the barrel portion 24 proximate the front end 46 of the barrel portion 24 and configured to receive a severed portion 108 (FIGS. 3 and 4) of the tail 36 (e.g., a portion of the tail 36 from the severed end 66 to the end of the tail 36). In operation, a portion of tail 36 (e.g., the severed portion 108) may extend through the top 26 of the barrel portion 24 (e.g., through the opening) upon being passed through the tie slot 96 of the spacer body 70 and the tie slot 52 of the cable tie tensioning and severing tool 12.

Those skilled in the art will appreciate that the spacer body 70 may include other features configured to match or otherwise cooperate with features of the cable tie tensioning and severing tool 12 to which it is connected. Accordingly, the disclosed spacer 10 is not limited to any particular style or configuration of cable tie tensioning and severing tool 12.

In another embodiment, the disclosed spacer 10 may be permanently affixed to or integral to the barrel portion 24 of the cable tie tensioning and severing tool 12. For example, the front end 46 of the barrel portion 24 may be configured to include a standoff portion substantially similar to the standoff portion 92 of the disclosed spacer 10. For example, the end plate 48 may extend outwardly from the front end 46 of the barrel portion 24 such that the forward surface 50 of the end plate 48 is longitudinally spaced away from the tie severing mechanism 44 at a sufficient distance to provide a protruding portion 64 of the tail 36 having an elongated cut-off length $l_2$ 68 (FIG. 4).

Figure 11:
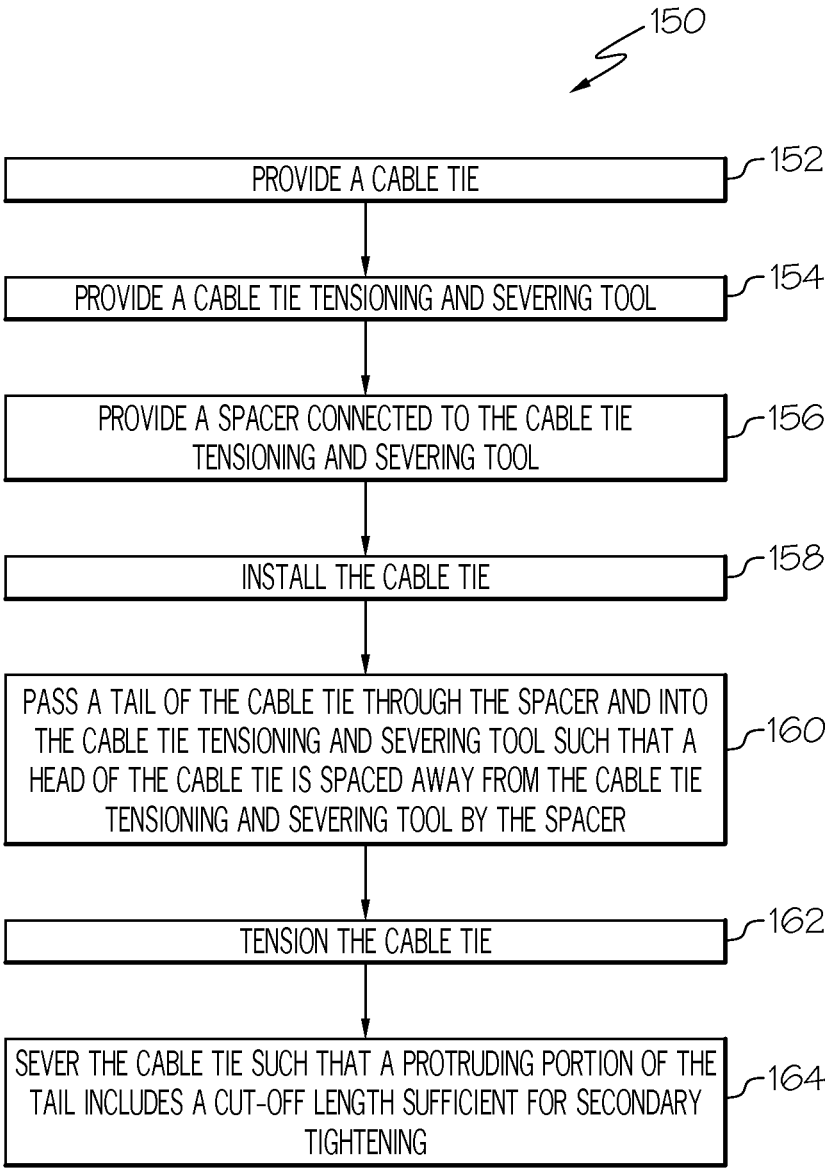
FIG. 11 is a flow diagram of one embodiment of the disclosed method for tensioning and severing a cable tie.

Referring to FIG. 11, also disclosed is a method, generally designated 150, for tensioning and severing a cable tie. As shown at block 152, the method 150 may begin with the step of providing a cable tie 14. The cable tie 14 may include a head 56 and an elongated tail 36 extending from the head 56.

As shown at block 154, a cable tie tensioning and severing tool 12 may be provided. The cable tie tensioning and severing tool 12 may be configured to tension and sever a cable tie 14 during installation of the cable tie 14 (e.g., around a bundle of wires 54) (FIGS. 1 and 2).

As shown at block 156, a spacer 10 connected the cable tie tensioning and severing tool 12 may be provided. A connector portion 90 of the spacer 10 may be connected (e.g., detachably or integrally) to a front end 46 of a barrel portion 24 of the cable tie tensioning and severing tool 12 (FIGS. 1 and 2).

As shown at block 158, the cable tie 14 may be installed around one or more object (e.g., the bundle of wires 54). A tail 36 of the cable tie 14 may be passed around the object and threaded through the head 56.

As shown at block 160, the tail 36 may be passed through the spacer 10 and into the cable tie tensioning and severing tool 12. The tail 36 may be passed through a tie slot 96 disposed through a forward surface 94 of a standoff portion 92 of the spacer 10 and through a tie slot 52 disposed in the front end 46 of the barrel portion 24 of the cable tie tensioning and severing tool 12. The head 56 may be longitudinally spaced away from a front end 18 of the cable tie tensioning and severing tool 12 by the standoff portion 92 of the spacer 10.

As shown at block 162, the cable tie 14 may be tensioned with the cable tie tensioning and severing tool 12 in order to tighten the cable tie 14 around the object 54.

As shown at block 164, the tail 36 may be severed with the cable tie tensioning and severing tool 12. A severed end 66 of the tail 36 may be longitudinally spaced away from the head 56 at a standoff distance defined by the standoff portion 92 of the spacer 10 (FIG. 4) such that a protruding portion 64 of the tail 36 may include a cut-off length $l_2$ 68 sufficient for a secondary tightening of the cable tie 14.

Figure 12:
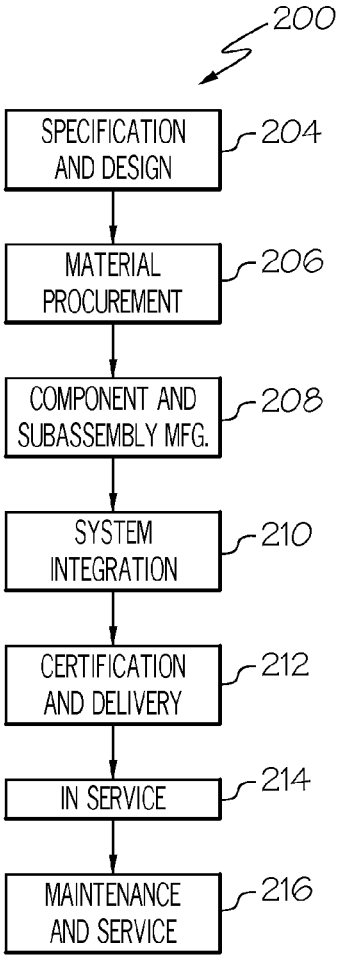
FIG. 12 is flow diagram of an aircraft production and service methodology.
Figure 13:
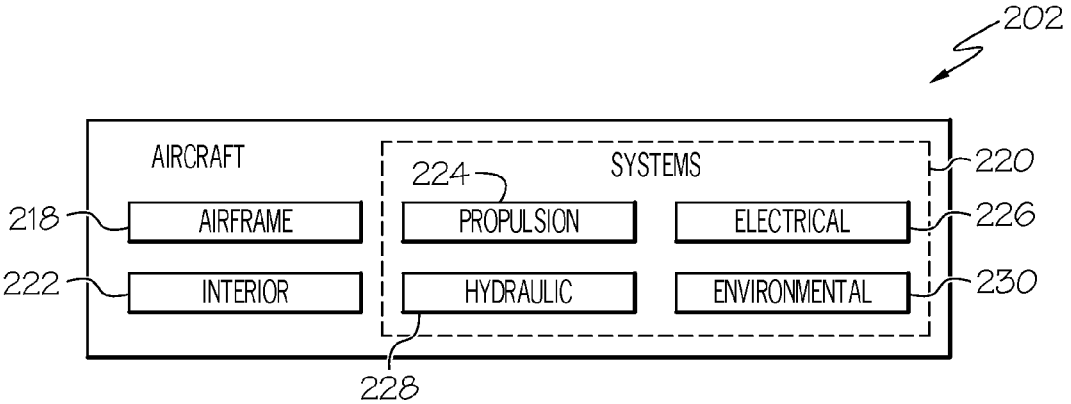
FIG. 13 is a block diagram of an aircraft.

Examples of the disclosure may be described in the context of an aircraft manufacturing and service method 200, as shown in FIG. 12, and an aircraft 202, as shown in FIG. 13. During pre-production, the aircraft manufacturing and service method 200 may include specification and design 204 of the aircraft 202 and material procurement 206. During production, component/subassembly manufacturing 208 and system integration 210 of the aircraft 202 takes place. Thereafter, the aircraft 202 may go through certification and delivery 212 in order to be placed in service 214. While in service by a customer, the aircraft 202 is scheduled for routine maintenance and service 216, which may also include modification, reconfiguration, refurbishment and the like.

Each of the processes of method 200 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 13, the aircraft 202 produced by example method 200 may include an airframe 218 with a plurality of systems 220 and an interior 222. Examples of high-level systems 220 include one or more of a propulsion system 224, an electrical system 226, a hydraulic system 228, and an environmental system 230. Any number of other systems may be included. Although an aerospace example is shown, the principles of the invention may be applied to other industries, such as the automotive industry.

Apparatus and methods embodied herein may be employed during any one or more of the stages of the production and service method 200. For example, components or subassemblies corresponding to component/subassembly manufacturing 208 may be fabricated or manufactured in a manner similar to components or subassemblies produced while the aircraft 202 is in service. Also, one or more apparatus examples, method examples, or a combination thereof may be utilized during component/subassembly manufacturing 208 and/or system integration 210, for example, by substantially expediting assembly of or reducing the cost of an aircraft 202. Similarly, one or more of apparatus examples, method examples, or a combination thereof may be utilized while the aircraft 202 is in service, for example and without limitation, to maintenance and service 216.

Accordingly, the disclosed spacer for cable tie tensioning and severing tools may advantageously provide an elongated cut-off length for a protruding portion of the tail of the cable tie sufficient for a secondary tightening process of the cable tie. By providing the protruding portion of the tail with a sufficient cut-off length, the cable tie may be retightened as needed, instead of being removed and discarded.

Although various embodiments of the disclosed spacer have been shown and described, modifications may occur to those skilled in the art upon reading the specification. The present application includes such modifications and is limited only by the scope of the claims.

What is claimed is:

1. A spacer comprising:

a spacer body configured to be detachably connected to a cable tie tensioning and severing tool, said cable tie tensioning and severing tool being configured for tensioning and severing of a cable tie, said cable tie comprising a head and an elongated tail extending from said head, and said cable tie tensioning and severing tool comprising a front end to receive said tail, a gripper assembly to tension said tail, and a severing mechanism to sever said tail;

wherein said spacer body is configured to longitudinally space said head away from said cable tie tensioning and severing tool by a distance that is greater than a longitudinal distance between said front end and said gripper assembly such that a portion of said tail protruding from said head upon severance of said cable tie comprises a cut-off length of that is greater than said longitudinal distance between said front end and said gripper assembly to allow said cable tie to be again tensioned and severed by said cable tie tensioning and severing tool when said spacer body is detached from said cable tie tensioning and severing tool.

2. The spacer of claim 1 wherein said cable tie tensioning and severing tool comprises a front end configured to receive said tail, and wherein said spacer body is detachably connected to said front end of said cable tie tensioning and severing tool.

3. The spacer of claim 2 wherein said spacer body is detachably connected to said front end of said cable tie tensioning and severing tool by a friction fit.

4. The spacer of claim 1 wherein said spacer body comprises:

a connector portion configured to be connected to a front end of said cable tie tensioning and severing tool, said front end of said cable tie tensioning and severing tool being configured to receive said tail; and a standoff portion extending from said connector portion, said standoff portion being configured to longitudinally space said head away from said front end of said cable tie tensioning and severing tool.

5. The spacer of claim 4 wherein said connector portion defines an open interior volume configured to receive at least a portion of said front end of said cable tie tensioning and severing tool.

6. The spacer of claim 4 wherein said standoff portion comprises:

a forward surface configured to engage said head; and a tie slot disposed through said forward surface, said tie slot being configured to receive said tail.

7. The spacer of claim 1 wherein said spacer body comprises a front end and a rear end, said spacer body further comprising:

a right sidewall longitudinally extending from said front end to said rear end;

a left sidewall longitudinally extending from said front end to said rear end, said left sidewall being laterally opposed to said right sidewall;

a front wall laterally extending between said right sidewall and said left sidewall, said front wall being disposed between said front end and said rear end;

an upper wall longitudinally extending from said front end to said rear end, said upper wall laterally extending between said right sidewall and said left sidewall;

a lower wall longitudinally extending from said front end to said rear end, said lower wall laterally extending between said right sidewall and said left sidewall opposite said upper wall; and an opening proximate said rear end longitudinally opposed to said front wall, said opening being configured to receive a front end of said cable tie tensioning and severing tool, said front end of said cable tie tensioning and severing tool being configured to receive said tail.

8. The spacer of claim 7 wherein a first portion of said right sidewall, a first portion of said left sidewall, a first portion of said upper wall, a first portion of said lower wall, and said front wall define a connector portion of said spacer body; wherein an interior surface of said connector portion defines an open interior volume configured to receive said front end of said cable tie tensioning and severing tool.

9. The spacer of claim 8 wherein said interior surface of said connector portion is configured to frictionally engage an exterior of said front end of said cable tie tensioning and severing tool.

10. The spacer of claim 8 wherein a second portion of said right sidewall, a second portion of said left sidewall, a second portion of said upper wall, and a second portion of said lower wall define a standoff portion of said spacer body; said standoff portion extending from said connector portion to said front end of said spacer body; wherein said standoff portion is configured to receive said tail.

11. The spacer of claim 10 wherein said standoff portion comprises:

a forward surface facing away from said connector portion, said forward surface being configured to engage said head; and a tie slot extending from said forward surface to said interior volume, said tie slot being configured to pass said tail through said standoff portion and into said front end of said cable tie tensioning and severing tool.

12. The spacer of claim 11 wherein said tie slot laterally extends from said left sidewall entirely through said right sidewall.

13. The spacer of claim 12 wherein said tie slot longitudinally extends through said right sidewall from said front end of said spacer body to said rear end of said spacer body.

14. The spacer of claim 11 wherein said first portion of said upper wall comprises a cutout accessing said interior volume, said cutout being configured to expose at least a portion of a top of said front end of said cable tie tensioning and severing tool.

15. The spacer of claim 1 wherein said spacer longitudinally spaces said head away from said front end of said cable tie tensioning and severing tool by between 10 mm and 50 mm such that said portion of said tail protruding from said head upon said tail being severed by said severing mechanism comprises said cut-off length of between 10 mm and 50 mm.

16. The spacer of claim 1 wherein said spacer longitudinally spaces said head away from said front end of said cable tie tensioning and severing tool by at least approximately 31 mm such that said portion of said tail protruding from said head upon said tail being severed by said severing mechanism comprises said cut-off length of at least approximately 31 mm.

17. A spacer for installing a cable tie, said cable tie comprising a head and an elongated tail extending from said head, said spacer comprising:

a cable tie tensioning and severing tool configured to tension and sever said cable tie, said cable tie tensioning and severing tool comprising a front end to receive said tail, a gripper assembly to tension said tail, and a severing mechanism to sever said tail; and a spacer detachably connected to said front end of said cable tie tensioning and severing tool, wherein said spacer longitudinally spaces said head away from said front end of said cable tie tensioning and severing tool by a distance that is greater than a longitudinal distance between said front end and said gripper assembly such that a portion of said tail protruding from said head upon said tail being severed by said severing mechanism comprises a cut-off length that is greater than said longitudinal distance between said front end and said gripper assembly to allow said cable tie to be again tensioned by said gripper assembly and severed by said severing mechanism when said spacer is detached from said cable tie tensioning and severing tool.

18. The spacer of claim 17 wherein said spacer comprises:

a connector portion defining an open interior volume to receive at least a portion of said front end of said cable tie tensioning and severing tool; and a standoff portion extending from said connector portion to longitudinally space said head away from said severing mechanism.

19. The spacer of claim 18 wherein said standoff portion comprises:

a forward surface longitudinally spaced from said front end of said cable tie tensioning and severing tool, said forward surface being configured to engage said head; and a tie slot disposed through said forward surface and accessing said interior volume, said tie slot being configured to pass said tail through said standoff portion and into said front end of said cable tie tensioning and severing tool.

20. The spacer of claim 17 wherein said spacer longitudinally spaces said head away from said front end of said cable tie tensioning and severing tool by between 10 mm and 50 mm such that said portion of said tail protruding from said head upon said tail being severed by said severing mechanism comprises said cut-off length of between 10 mm and 50 mm.

* * * * *